United States Patent [19]

Kato et al.

[11] Patent Number: 4,977,055

[45] Date of Patent: Dec. 11, 1990

[54] LIQUID DEVELOPER FOR ELECTROSTATIC PHOTOGRAPHY

[75] Inventors: Eiichi Kato; Kazuo Ishii; Hideyuki Hattori, all of Shizuoka, Japan

[73] Assignee: Fuji Photo Film Co., Ltd., Kanagawa, Japan

[21] Appl. No.: 454,830

[22] Filed: Dec. 22, 1989

[30] Foreign Application Priority Data

Dec. 22, 1988 [JP] Japan ..... 63-322168
Jun. 19, 1989 [JP] Japan ..... 1-154532

[51] Int. Cl.[5] ..... G03G 9/12
[52] U.S. Cl. ..... 430/114; 430/904
[58] Field of Search ..... 430/114, 904

[56] References Cited

U.S. PATENT DOCUMENTS 4,665,002 5/1987 Dan et al. ..... 430/114
4,842,975 6/1989 Kato et al. ..... 430/114 X

*Primary Examiner*—J. David Welsh
*Attorney, Agent, or Firm*—Sughrue, Mion, Zinn, Macpeak & Seas

[57] ABSTRACT

A liquid developer for electrostatic photography comprising a resin dispersed in a non-aqueous solvent having an electric resistance of at least $10^9$ Ωcm and a dielectric constant of not higher than 3.5, wherein the dispersed resin is a polymer resin obtained by polymerizing a solution containing at least one mono-functional monomer (A) which is soluble in the aforesaid non-aqueous solvent but becomes insoluble after being polymerized, in the presence of at least one resin which is soluble in the aforesaid non-aqueous solvent and does not have a graft group polumerizable with the monomer and at least one oligomer (B) having a number average molecular weight of not more than $1\times10^4$ and having at least one polar group selected from a carboxy group, a sulfo group, a hydroxy group, a formyl group, an amino group, a phosphono group, and

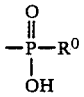

wherein $R^0$ represents a hydrocarbon group or $—OR^1$, (wherein $R^1$ represents a hydrocarbon group) bonded to one terminal only of the main chain of a polymer composed of a recurring unit represented by following formula (I):

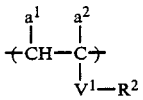

(I)

wherein $V^1$, $R^2$, $a^1$ and $a^2$ are as defined in the specification.

The liquid developer is excellent in dispersion stability, re-dispersibilty, and fixability, and also is capable of forming an offset printing plate having excellent ink-receptivity for printing ink and excellent printing durability by electrophotography.

7 Claims, No Drawings

LIQUID DEVELOPER FOR ELECTROSTATIC PHOTOGRAPHY

FIELD OF THE INVENTION

This invention relates to a liquid developer for electrophotography, which comprises a resin dispersed in a liquid carrier having an electric resistance of at least $10^9$ Ωcm and a dielectric constant of not higher than 3.5, and more particularly to a liquid developer excellent in re-dispersibility, storability, stability, image-reproducibility, and fixability.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, and further adding a polarity-controlling agent such as a metal soap, lecithin, linseed oil, a higher fatty acid, a vinyl pyrrolidone-containing polymer, etc. to the resulting dispersion.

In such a developer, the resin is dispersed in the form of insoluble latex grains having a grain size of from several μm to several hundred μm. In a conventional liquid developer, however, the soluble dispersion-stabilizing resin and the polarity-controlling agent are insufficiently bonded to the insoluble latex grains, so that the soluble dispersion-stabilizing resin and the polarity-controlling agent become freely dispersed in the liquid developer with ease. Accordingly, the soluble dispersion-stabilizing resin would be split off from the insoluble latex grains after storage of the liquid developer for a long period of time or after repeated use thereof, so that the grains would thereafter defectively precipitate, coagulate or accumulate, or the polarity would thereby become indistinct. Since the grains once coagulated and accumulated are reluctant to re-disperse, the grains would be adhered to everywhere in the developing machine, and, as a result, cause stain of images formed and malfunction of the developing machine such as clogging of the liquid-feeding pump.

In order to overcome such defects, a means of chemically bonding the soluble dispersion-stabilizing resin and the insoluble latex grains is disclosed in U.S. Pat. No. 3,990,980. However, the liquid developer disclosed was still insufficient, although the dispersion stability to spontaneous precipitation of the grains was improved in some degree. When the liquid developer was actually used in a developing apparatus, the toner adhered to parts of the apparatus and solidified to form a film thereon, and the thus solidified toner grains could hardly be redispersed. In addition, the solidified toner grains caused stain of the images duplicated and troubles in the apparatus. Accordingly, the liquid dispersion as disclosed in U.S. Pat. No. 3,990,980 was found to have a defect that the re-dispersion stability was still insufficient for practical use.

In accordance with the method of preparing the resin grains as disclosed in U.S. Pat. No. 3,990,980, there is an extreme limitation on the combination of the dispersing stabilizer to be used and the monomers to be insolubilized, in order to prepare monodispersed grains having a narrow grain size distribution. Mostly, the resin grains prepared by the method would contain a large amount of coarse grains having a broad grain size distribution, or would be polydispersed grains having two or more different mean grain sizes. In accordance with such a method, it is difficult to obtain monodispersed grains having a narrow grain size distribution and having a desired mean grain size, and the method often results in large grains having a grain size of 1 μm or more, or extremely fine grains having a grain size of 0.1 μm or less. In addition, the dispersion stabilizer to be used in the method has another problem in that it must be prepared by an extremely complicated process requiring a long reaction time.

In order to overcome the aforesaid defects, a method of forming insoluble dispersion resin grains of a copolymer from a monomer to be insolubilized and a monomer containing a long chain alkyl moiety, so as to improve the dispersibility, re-dispersibility and storage stability of the grains, has been disclosed in JP-A-60-179751 and JP-A-62-151868 (the term "JP-A" as used herein means an "unexamined published Japanese patent application").

On the other hand, a method of printing a large number of prints of 5000 or more prints has recently been developed, using an offset printing master plate by electrophotography. In particular, because of further improvement of the master plate, it has become possible to print 10,000 or more prints of large size by electrophotography. In addition, noticeable progress has been made in shortening the operation time in an electrophotomechanical system, and the step of development-fixation in the system has been conveniently accelerated.

The grains prepared by the methods disclosed in aforesaid JP-A-60-179751 and JP-A-61-151868 might be good in the mono-dispersibility, re-dispersibility, and storage stability of the grains, but showed unsatisfactory performance with respect to the printability for master plates of a large size and quickening of the fixation time.

Also, the dispersion resin grains prepared by the methods disclosed in aforesaid JP-A-60-185962 and JP-A-61-43757 were not always satisfactory in the points of the dispersibility and re-dispersibility of the grains and in the point of printability in the case of a shortened fixation time or in the case of master plates of a large size (e.g., A-3 size (297×420 $mm^2$)) or larger.

SUMMARY OF THE INVENTION

This invention has been made for solving the aforesaid problems inherent in conventional liquid developers.

An object of this invention is to provide a liquid developer excellent in dispersion stability, re-dispersibility, and fixability, and in particular to provide a liquid developer excellent in dispersion stability, re-dispersibility, and fixability even in an electrophotomechanical system wherein the development-fixation step is quickened and master plates of a large size are used.

Other object of this invention is to provide a liquid developer capable of forming an offset printing plate having excellent ink-receptivity for printing ink and excellent printing durability by electrophotography.

Still other object of this invention is to provide a liquid developer suitable for various electrostatic photographies and various transfer systems in addition to the aforesaid uses.

A further other object of this invention is to provide a liquid developer capable of being used for any liquid developer-using systems such as ink jet recording, cathode ray tube recording, and recording by pressure variation or electrostatic variation.

The aforesaid objects have been attained by the present invention as set forth hereinbelow.

That is, according to this invention, there is provided a liquid developer for electrostatic photography comprising a resin dispersed in a non-aqueous solvent having an electric resistance of at least $10^9$ Ωcm and a dielectric constant of not higher than 3.5, wherein the dispersed resin is a polymer resin obtained by polymerizing a solution containing at least one monofunctional monomer (A) which is soluble in the aforesaid non-aqueous solvent but becomes insoluble after being polymerized, in the presence of at least one resin which is soluble in the aforesaid non-aqueous solvent and does not have a graft group polymerizable with the monomer (a dispersion stabilizing resin) and at least one oligomer (B) having a number average molecular weight of not more than $10^4$ and having at least one polar group selected from a carboxy group, a sulfo group, a hydroxy group, a formyl group, an amino group, a phosphono group, and

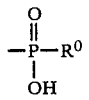

wherein $R^0$ represents a hydrocarbon group or $—OR^1$ (wherein $R^1$ represents a hydrocarbon group) bonded to one terminal only of the main chain of a polymer composed of a recurring unit represented by following formula (I):

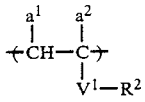

(I)

Wherein $V^1$ represents —COO—, —OCO—, $CH_2)_lCOO$—, $CH_2)_lOCO$—, —O—, $—SO_2$—, —CONHCOO—, —CONHCONH—,

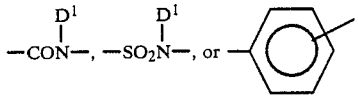

(wherein $D^1$ represents a hydrogen atom or a hydrocarbon group having from 1 to 22 cabon atoms and l represents an integer of from 1 to 3); $R^2$ represents a hydrocarbon group having from 1 to 22 carbon atoms, which may contain —O—, —CO—, $—CO_2$—, —OCO—, $—SO_2$—,

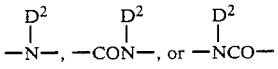

(wherein $D^2$ has the same significance as $D^1$ described above) in the carbon chain thereof; and $a^1$ and $a^2$, which may be the same or different, each represents a hydrogen atom, a halogen atom, a cyano group, a hydrocarbon group having 1 to 22 carbon atoms, $—COO—D^3$, or $—COO—D^3$ bonded through a divalent hydrocarbon group having 1 to 22 carbon atoms (wherein $D^3$ represents a hydrogen atom or a hydrocarbon group having 1 to 22 carbon atoms which may be substituted).

DETAILED DESCRIPTION OF THE INVENTION

Then, the liquid developer of this invention is described in detail.

As the liquid carrier for the liquid developer of this invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be preferably used. Examples thereof are octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar is a trade name of Exxon Co.), Shellsol 70, Shellsol 71 (Shellsol is a trade name of Shell Oil Co.), Amsco OMS and Amsco 460 Solvent (Amsco is a trade name of American Mineral Spirits Co.). They may be used singly or as a combination thereof.

The non-aqueous dispersion resin grains (dispersed resin grains) (hereinafter often referred to as "latex grains") which are the most important constituting element in this invention are polymer resin grains obtained by polymerising (so-called a polymerization granulation method) the aforesaid monomer (A), in the presence of the dispersion stabilizing resin and the oligomer (B) in a non-aqueous solvent.

As the non-aqueous solvent for use in this invention, any solvents miscible with the aforesaid liquid carrier for the liquid developer for electrostatic photography can be basically used in this invention.

That is, the non-aqueous solvent being used in the production of the dispersion resin grains may be any solvent miscible with the aforesaid liquid carrier and preferably includes straight chain or branched aliphatic hydrocarbons, alicyclic hydrocarbons, aromatic hydrocarbons, and halogen-substituted derivatives thereof. Specific examples thereof are hexane, octane, isooctane, decane, isodecane, decalin, nonane, isododecane, and isoparaffinic petroleum solvents such as Isopar E, Isopar G, Isopar H, Isopar L, Shellsol 70, Shellsol 71, Amsco OMS and Amsco 460. They may be used singly or as a combination thereof.

Other solvents which can be used together with the aforesaid organic solvent in this invention include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propio nate, and ethyl propionate), ethers (e.g., diethyl ether, dipropyl ether, tetrahydrofuran, and dioxane), and halogenated hydrocarbons (e.g., methylene dichlo ride, chloroform, carbon tetrachloride, dichloroethane, and methyl chloroform).

It is preferred that the non-aqueous solvents which are used as a mixture thereof are distilled off by heating or under a reduced pressure after the polymerization granulation. However, even when the solvent is carried in the liquid developer as a dispersion of the latex grains, it gives no problem if the liquid electric resistance of the developer is in the range of satisfying the condition of at least $10^9$ Ωcm.

In general it is preferred that the same solvent as the liquid carrier is used in the step of forming the resin dispersion and, as such a solvent, there are straight chain or branched aliphatic hydrocarbons, alicyclic hydrocarbons, aromatic hydrocarbons, halogenated hydrocarbons, etc., as described above.

The dispersion stabilizing resin which is necessary for forming a stable resin dispersion of the polymer insoluble in the non-aqueous solvent formed by polymerizing the aforesaid monomer in the solvent is a resin which does not have a graft group polymerizing with a monomer, and a conventionally known dispersion stabilizing resin can be used.

That is, various kinds of synthetic resins or natural resins each soluble in the non-aqueous solvent can be used singly or as a combination thereof. Examples thereof are esters of acrylic acid, methacrylic acid or crotonic acid each having an alkyl or alkenyl chain having from 6 to 32 carbon atoms (the aforesaid aliphatic group may have a substituent such as a halogen atom, a hydroxy group, an amino group, an alkoxy group, etc., or the carbon-carbon bond as the main chain may include therein a hetero atom such as oxygen, sulfur, nitrogen, etc.), higher aliphatic acid vinyls having from 6 to 22 carbon atoms, alkyl vinyl ethers, a homopolymer of an olefin such as butadiene, isoprene, diisobutyrene, etc., or a copolymer of two or more such olefins, and copolymers obtained by polymerizing the aforesaid monomer forming the polymer soluble in the non-aqueous solvent and at least one of various kinds of monomers shown below at a ratio that the copolymer being formed is soluble in the non-aqueous solvent.

As the aforesaid monomers, there are, for example, vinyl acetate, allyl acetate, methyl, ethyl or propyl esters of an unsaturated carboxylic acid such acrylic acid, methacrylic acid, crotonic acid, maleic acid, itaconic acid, etc., styrene derivatives (e.g., styrene, vinyltoluene, and α-methylstyrene), unsaturated carboxylic acids such as acrylic acid, methacrylic acid, crotonic acid, maleic acid, itaconic acid, etc., or the acid anhydrides thereof, and monomers having various polar groups such as a hydroxy group, an amino group, an amido group, a cyano group, a sulfonic acid group, a carbonyl group, a halogen atom, a heterocyclic ring, etc., (e.g., hydroxyethyl methacrylate, hydroxyethyl acrylate, diethylaminoethyl methacrylate, N-vinylpyrrolidone, acrylamide, acrylonitrile, 2-chloroethyl methacrylate, and 2,2,2-trifluoroethyl methacrylate).

Furthermore, in addition to the aforesaid synthetic resins, there are alkyl resins, alkyd resins denatured by various kinds of fatty acids, and natural resins such as linseed oil-denatured polyurethane resins.

The monomer (A) used in this invention includes any monofunctional monomers which are insoluble in the non-aqueous solvent but become insoluble therein by being polymerized. Practically, monomers shown by for example, following formula (A-1) can be used in this invention.

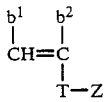

(A-1)

wherein T represents —COO—, —OCO, —$CH_2$OCO—, —$CH_2$COO—, —O—,

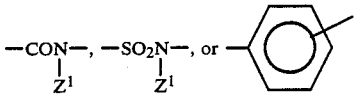

(wherein $Z^1$ represents a hydrogen atom or an aliphatic group having from 1 to 18 carbon atoms, which may be substituted (e.g., methyl, ethyl, propyl, .butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl)), Z represents a hydrogen atom or an aliphatic group having from 1 to 6 carbon atoms, which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl), and $b^1$ and $b^2$, which may be the same or different, each has the same meaning as $a^1$ or $a^2$ in the formula (I) described above.

Specific examples of the monomer (A) are vinyl esters or allyl esters of an aliphatic carboxylic acid having from 1 to 6 carbon atoms (e.g., acetic acid, propionic acid, butyric acid, monochloric acid, trifluoropropionic acid); alkyl esters or amides having from 1 to 4 carbon atoms, which may be substituted, of an unsaturated carboxylic acid such as acrylic acid, methacrylic acid, crotonic acid, itaconic acid, maleic acid, etc., (examples of the alkyl moiety are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, an vinylbenzenesulfonamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile and heterocyclic compounds having a polymerizable double bond group (practically, the compounds described in *Polymer Data Handbook, Foundation,* pages 175–184, edited by Polymer Society of Japan, published by Baifukan, 1986, such as N-vinylpyridine, N-vinylimidazole, N-vinylpyrrolidone, vinylthiophene, vinyltetrahydrofuran, vinyloxazoline, vinylthiazole, N-vinylmorpholine, etc.

The aforesaid monomers (A) may be used singly or as a mixture thereof.

The oligomer (B) used in this invention is an oligomer having a number average molecular weight of not more than $10^4$ and having the specific polar group described above bonded to one terminal only of the main chain of the polymer composed of the recurring unit shown by the aforementioned formula (I).

In formula (I) described above, the hydrocarbon groups contained in $a^1$, $a^2$, $V^1$, and $R^2$ include, for example, an alkyl group, an alkenyl group, an alicyclic group and an aryl group, each having the carbon atom number (as unsubstituted hydrocarbon group) indicated above, and these hydrocarbon groups may be substituted.

In formula (I), $D^1$ in the groups shown by $V^1$ represents a hydrogen atom or a hydrocarbon group and examples of the preferred hydrocarbon group are an alkyl group having from 1 to 22 carbon atoms, which may be substituted (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2 bromoethyl, 2-cyanoethyl, 2-methoxycarbonylethyl, 2-methoxyethyl, and 3-bromopropyl), an alkenyl group having from 4 to 18 carbon atoms, which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, and linolenyl), an aralkyl group having from 7 to 12 carbon atoms, which may be substituted (e.g., benzyl, phenethyl, 3-phenylpropyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms, which may be substituted (e.g., cyclohexyl, 2-cyclohexylethyl, and 2-cyclopentylethyl), and an aromatic group having from 6 to 12 carbon atoms, which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $V^1$ represents

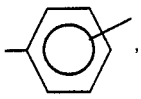

the benzene ring may have a substituted such as a halogen atom (e.g., chlorine and bromine), an alkyl group (e.g., methyl, ethyl, propyl, butyl, chloromethyl, and methoxymethyl), etc.

In formula (I), $R^2$ represents preferably a hydrocarbon group having from 1 to 22 carbon atoms and practically the aforesaid hydrOCarbon groups on $D^1$. $R^2$ may contain in the carbon chain —O—, —CO—, $—CO_2—$, $—SO_2—$, $$-\overset{D^2}{\overset{|}{N}}-,\ -\overset{D^2}{\overset{|}{CON}}-,\ \text{or}\ -\overset{D^2}{\overset{|}{N}}CO-$$

(wherein $D^2$ has the same meaning as $D^1$).

In formula (I), $a^1$ and $a^2$, which may be the same or different, each represents preferably a hydrogen atom, a halogen atom (e.g., chlorine and bromine), a cyano group, an alkyl group having from 1 to 3 carbon atoms (e.g., methyl, ethyl, and propyl), $—COO—D^3$, or $—CH_2COOD^3$ (wherein $D^3$ represents a hydrogen atom, an alkyl group having from 1 to 18 carbon atoms, an alkenyl group, an aralkyl group, an alicyclic group, or an aryl group, each of these groups may be substituted, and practical examples of these groups are same as those described above for $D^1$).

Furthermore, in a preferred embodiment of this invention, $R^2$ in the recurring unit shown by the aforesaid formula (I) in the oligomer (B) used in this invention is a component containing at least one specific polar group and, thus, the recurring unit contains at least two such specific polar groups in the molecule. Examples of such recurring units are represented by the following formula (Ia):

$$\begin{array}{l} \overset{a^1}{\overset{|}{\text{CH}}}-\overset{a^2}{\overset{|}{\text{C}}} \\ \qquad\quad \overset{|}{V^1}\text{-}(W^1-X^1)_m\text{-}(W^2-X^2)_n\text{-}R^5 \end{array} \qquad \text{(Ia)}$$

wherein $a^1$, $a^2$, and $V^1$ have the same meanings as those described for Formula (I); $X^1$ and $X^2$, which may be the same or different, each represents —O—, —CO—, $—CO_2—$, $—SO_2—$, $$-\overset{D^5}{\overset{|}{N}}-,\ -\overset{D^5}{\overset{|}{CON}}-,\ \text{or}\ -\overset{D^5}{\overset{|}{N}}CO-$$

(wherein $D^5$ has the same meaning as $D^1$ in formula (I)); $W^1$ and $W^2$, which may be the same or different, each represents a hydrocarbon group having from 1 to 18 carbon atoms (examples of the hydrocarbon group are an alkyl group, an alkenyl group, an aralkyl group, or an alicyclic group) which may include $$\begin{array}{l} \text{-(CH)-} \\ \quad\ \ \overset{|}{X^3}\text{-}(W^3-X^4)_p\text{-}R^5 \end{array}$$

in the main chain bond (wherein $X^3$ and $X^4$, which may be the same or different, have the same meanings as $X^1$ and $X^2$ described above and $W^3$ represents a hydrocarbon group having from 1 to 18 carbon atoms, which may be substituted, same as those shown by $W^1$ or $W^2$).

Furthermore, $W^1$ or $W^2$ in formula (I) each is specifically composed of an optional combination of the atomic group such as $$\begin{array}{l} \overset{D^7}{\overset{|}{\text{C}}} \\ \quad\ \ \underset{D^8}{\underset{|}{}} \end{array}$$

(wherein $D^7$ and $D^8$ each represents a hydrogen atom, an alkyl group, or a halogen atom),

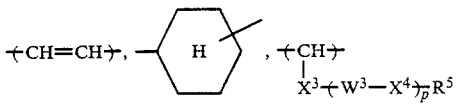

wherein $X^3$, $X^4$, and $W^3$ are same as defined above and $R^5$ and D are same as shown below), etc.

In the aforesaid formulae, m, n, and p, which may be the same or different, each represents 0, 1, 2, or 3, with the proviso that m, n and p cannot be 0 at the same time.

In the aforesaid formulae, $R^5$ represents a hydrogen atom or a hydrocarbon group having from 1 to 22 carbon atoms, is preferably an aliphatic group having from 1 to 22 carbon atoms, which may be substituted, and has practically the same meaning as $R^2$ in formula (I).

Furthermore, it is preferred that each atomic group of $V^1$, $W^1$, $X^1$, $W^2$, or $R^5$ in formula (I) is composed of at least 8 atoms.

Then, specific examples of the recurring unit shown by formula (Ia) are illustrated below but the scope of the invention is not limited thereto.

In addition, in the following, formulae, a represents —H or —$CH_3$; R represents an alkyl group having from 1 to 18 carbon atoms; R′ represents a hydrogen atom or an alkyl group having from 1 to 18 carbon atoms; $k^1$ and $k^2$ each represents an integer of from 1 to 12; and $l^1$ represents an integer of from 1 to 100.

(A)-1

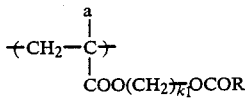

(A)-2

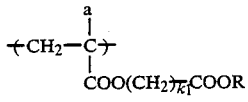

(A)-3

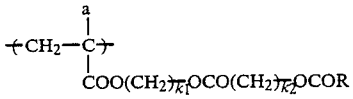

(A)-4

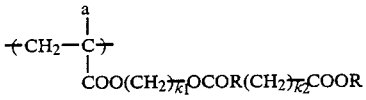

(A)-5

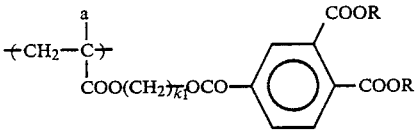

(A)-6

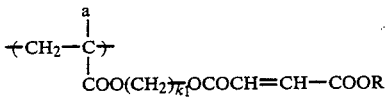

(A)-7

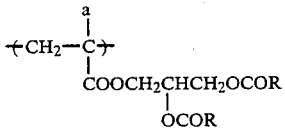

(A)-8

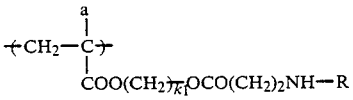

(A)-9

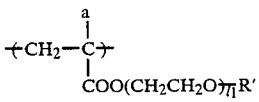

-continued (A)-10

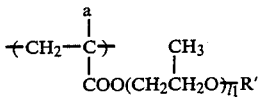

(A)-11

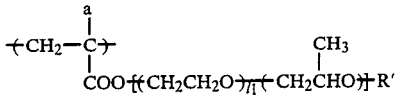

(A)-12

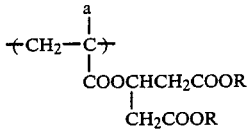

(A)-13

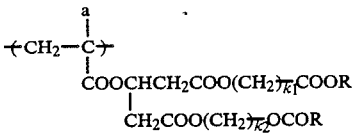

(A)-14

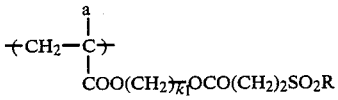

(A)-15

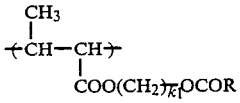

(A)-16

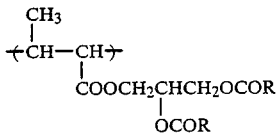

(A)-17

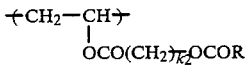

(A)-18

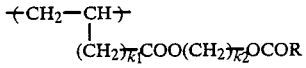

In the polar group

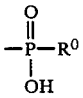

bonded to only one terminal of the main chain of the polymer having a number average molecular weight of not more than $1\times10^4$ and having at least one recurring unit shown by aforesaid formula (I), $R^0$ represents —$R^1$ or —$OR^1$ (wherein $R^1$ represents a hydrocarbon group having from 1 to 18 carbon atoms). Preferred examples of the hydrocarbon group shown by $R^1$ are an aliphatic group having from 1 to 8 carbon atoms, which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl) or an aromatic group which may be substituted (e.g., phenyl, tolyl, xylyl, mesityl, chlorophenyl, bromophenyl, methoxyphenyl and cyanophenyl).

Also, the amino group as the polar group in this invention is $-NH_2$, $-NHR^9$, or

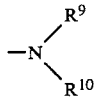

(wherein $R^9$ each represents a hydrocarbon group having from 1 to 18 carbon atoms, and preferably from 1 to 8 carbon atoms, and practically same as the hydrocarbon groups shown by $R^1$ described above).

More preferably, the hydrocarbon group shown by $R^1$, $R^9$, or $R^{10}$ is an alkyl group having from 1 to 4 carbon atoms, which may be substituted, a benzyl group which may be substituted, or a phenyl group which may be substituted.

The polar group is bonded to one terminal of the main chain of the polymer directly or via an optional linkage group. The group linking the moiety (recurring unit) of formula (I) and the polar group is composed of an optional combination of the atomic group of a carbon-carbon bond (single bond or double bond), a carbon-hetero atom bond (examples of the hetero atom are oxygen, sulfur, nitrogen, and silicon), or a hetero atom-hetero atom bond.

Preferred oligomers in the oligomer (B) for use in this invention are shown by following formula (VIa) or (VIb);

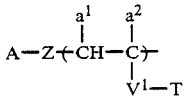

(VIa)

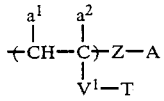

(VIb)

wherein $a^1$, $a^2$,and $V^1$ are same as those in formula (I) and T represents $R^5$ in formula (I) or $W^1—X^1)_m(-W^2—X^2)_nR^5$ in formula (Ia).

Also, in the aforesaid formulae, A represents the aforesaid polar group bonded to one terminal in formula (I) and Z represents a simple bond, a linkage group selected from the atomic groups of

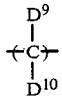

[wherein $D^9$ and $D^{10}$ each, independently, represents a hydrogen atom, a halogen atom (e.g., fluorine, chlorine, and bromine), a cyano group, a hydroxy group, or an alkyl group (e.g., methyl, ethyl, and propyl)],

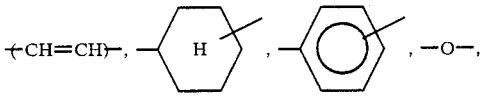

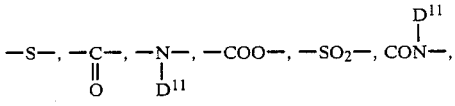

-continued

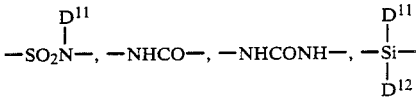

(wherein $D^{11}$ and $D^{12}$ each, independently, represents a hydrogen atom or the hydrocarbon group as that of $D^1$ described above), etc., or a linkage group composed of an optional combination of the aforesaid atomic group.

If the number average molecular weight of the oligomer (B) is more than $1\times10^4$, the printing resistance of the printing plate obtained using the liquid developer is lowered. On the other hand, if the molecular weight it too small, there is a tendency of causing stains and hence the number average molecular weight of the oligomer (B) is preferably higher than $1\times10^3$.

The oligomer (B) for use in this invention is composed of a homopolymer component or a copolymer component selected from the recurring units shown by formula (I) or a copolymer component obtained by the copolymerization of a monomer corresponding to the recurring unit shown by formula (I) and other monomer copolymerizable with said monomer.

Other monomers which can be a copolymer component together with the polymer component of formula (I) include, for example, acrylonitrile, methacrylonitrile, a heterocyclic compound having a polymerizable double bond group [practically, the compounds same as the heterocyclic compounds described above for the monomer (A)], and a compound having a carboxyamido group or a sulfoamido group and a polymerizable double bond group (e.g., acrylamide, methacrylamide, diacetoneacrylamide, 2-carboxyamidoethyl methacrylate, vinylbnzenecarboxyamide, vinylbenzenesulfoamide, and 3-sulfoamidopropyl methacrylate).

The proportion of the recurring unit represented by aforesaid formula (I) or (Ia) in the oligomer (B) can be suitably from about 30% to about 100% by weight, and preferably from 50% to 100% by weight.

Also, it is preferred that the main chain of the polymer does not contain a copolymer component containing the polar group such as a phosphono group, a carboxy group, a sulfo group, a hydroxy group, a formyl group, an amino group, and

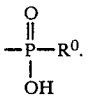

The oligomer (B) for use in this invention having the specific polar group bonded to only one terminal of the polymer main chain can be easily prepared by (1) a method of reacting various reagents with the terminal of a living polymer obtained by an anion polymerization or a cation polymerization (a method by ion polymerization), (2) a method of performing a radical polymerization using a polymerization initiator and/or a chain transfer agent containing a specific polar group in the molecule (a method by radical polymerization), or (3) a method of converting a reactive group bonded to the terminal of the polymer obtained by the aforesaid ion polymerization method or the radical polymerization method into the specific polar group in this invention by a macromolecular reaction.

Practically, the oligomer can be produced by the methods described in P. Drefuss and R. P. Quirk, *Encycl. Polym. Sci. Eng,* 7, 551(1987), Yoshiki Nakajoo and Yuya Yamashita, *Senryo to Yakuhin (Dyes and Chemicals),* 30, 232(1985), Akira Ueda and Susumu Nagai, *Kagaku to Kogyo (Science and Industry),* 60, 57(1986), and the literatures cited in these literature references.

Examples of the polymerization initiator having the aforesaid specific polar group in the molcule are 4,4'-azobis(4-cyanovaleric acid), 4,4'-azobis(cyanovaleric acid chloride), 2,2'-azobis(2-cyanopropanol), 2,2'-azaobis(2-cyanopentanol), 2,2'-azobis[2-methyl-N-(2-hydroxyethyl)propioamide], 2,2'-azobis{2-methyl-N-[1,1-bis(hydroxymethyl)ethyl]propioamide}, 2,2'-azobis{3-methyl-N-[1,1-bis(hydroxymethyl)-2-hydroxyethyl]propioamide}, 2,2'-azobis[2-(5-methyl-2-imidazolin-2-yl)propane], 2,2'-azobis[2-(4,5,6,7-tetrahydro-lH-1,3-diazepin-2-yl)propane] , 2,2'-azobis[2-(3,4,5,6-tetrahydropyrimidin 2-yl)propane], 2,2'-azobis[2-(5-hydroxy-3,4,5,6-tetrapyrimidin-2-yl)propane], 2,2'-azobis{2-[1-(2-hydroxyethyl)-2-imidazolin-2-yl]propane.}, 2,2'-azobis[N-(2-hydroxyethyl)-2-methylpropionamidine], and 2,2'-azobis[N-(4-aminophenyl)-2-methylpropionamidine].

Also, the chain transfer agent having the specific polar group in the molecule includes, for example, mercapto compounds, disulfide compounds, and iodide-substituted compounds but mercapto compounds are preferred. Examples thereof are thioglycolic acid, 2-mercaptopropionic acid, thiomalic acid, 2-mercaptoethanesulfonic acid, 2-mercaptoethanol, 2-mercaptoethylamine, thiosalicyclic acid, α-thioglycerol, 2-phosphonoethylmercaptan, hydroxythiophenol, and derivatives of these mercapto compounds.

The amount of the polymerization initiator and/or the chain transfer agent is from about 0.5% to about 20% by weight, and preferably from 1% to 10% by weight based on the total amount of the monomer corresponding to the recurring unit shown by formula (I) and other polymerization monomer(s).

As the oligomer (B) used in this invention, the oligomer shown by formula (VIa) or (VIb) described above is preferred, and specific examples of the moiety shown by A-Z- in these formulae are shown below but the scope of this invention is not limited thereto.

In addition, in the following formulae, $k_1$ represents 1 or 2; $k_2$ represents an integer of from 2 to 16; and $k_3$ represents 1 or 3.

$HOOC(CH_2)_{k1}S-$ (B)-1

$HOOC-CH(HOOC-CH_2)-S-$ (B)-2

$HOOC(CH_2)_{k2}OOC(CH_2)_{k1}S-$ (B)-3

$HOOC(CH_2)_{k2}NHCO(CH_2)_{k1}S-$ (B)-4

(B)-5

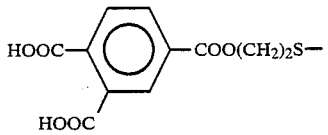

-continued (B)-6

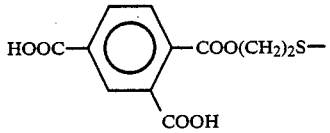

$HO(CH_2)_{k1}S-$ (B)-7

$H_2N(CH_2)_{k2}S-$ (B)-8

$HOCH(HOCH_2)-CH_2S-$ (B)-9

$HO-P(=O)(OH)-O(CH_2)_{k2}S-$ (B)-10

$R-O-P(=O)(OH)-O(CH_2)_{k2}S-$ (B)-11

R: an alkyl group having 1 to 6 carbon atoms $HO_3S(CH_2)_2S-$ (B)-12

(B)-13

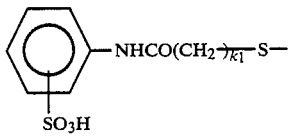

(B)-14

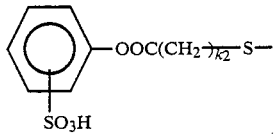

(B)-15

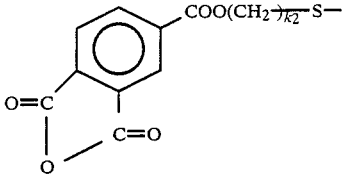

(B)-16

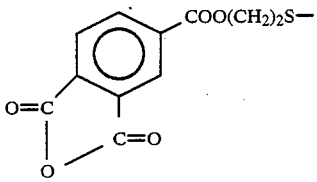

(B)-17

$HOOC(CH_2)_2C(CH_3)(CN)$ (B)-18

$HO(CH_2)_{k3}C(CH_3)(CN)$ (B)-19

$HO(CH_2)_{k2}OOC(CH_2)_2C(CH_3)(CN)$

-continued (B)-20

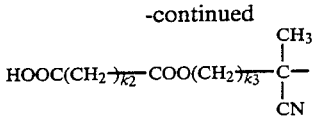

(B)-21

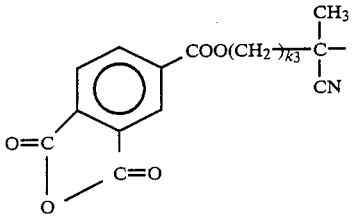

(B)-22

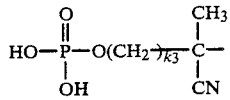

(B)-23

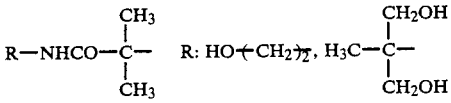

(B)-24

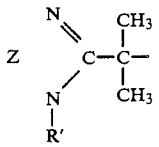

Z: $\text{-}(CH_2)_3\text{-}$, $\text{-}(CH_2)_4\text{-}$, $\text{-}CH_2CH(OH)CH_2\text{-}$ R': -H, $\text{-}CH_2CH_2OH$ (B)-25

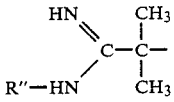

R'': $\text{-}CH_2CH_2OH$, 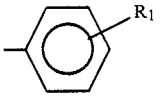

($R_1$: H, $\text{-}NH_2$, -OH)

(B)-26

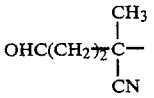

(B)-27

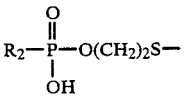

$R_2$: an alkyl group having 1 to 6 carbon atoms (B)-28

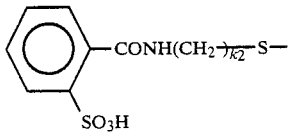

(B)-29

$HOOC(CH_2)_2NH(CH_2)_{k1}\text{-}S\text{-}$ (B)-30

$HOOC(CH_2)_2CONH(CH_2)_{k2}\text{-}S\text{-}$

The dispersion resin for use in the liquid developer of this invention is composed of at least one kind of the monomer (A) and at least one kind of the oligomer (B) and it is important that the resin produced from the aforesaid components is insoluble in the aforesaid non-aqueous solvent and in such a case, the desired dispersion resin can be obtained.

More specifically, the oligomer (B) is used in an amount of preferably from about 0.05 to about 10%, more preferably from 0.1 to 5% by weight, and most preferably from 0.3 to 3% by weight based on the monomer (A) used for insolubilizing the resin formed in the aforesaid non-aqueous solvent. Also, the molecular weight of the dispersion resin for use in this invention is from about $10^3$ to about $10^6$, and preferably from $1\times10^4$ to $5\times10^5$.

For producing the dispersion resin for use in this invention, the aforesaid dispersion stabilizing resin, the monomer (A), and the oligomer (B) may be polymerized by heating in the non-aqueous solvent in the presence of a polymerization initiator such as benzoyl peroxide, azobisisobutyronitrile, butyllithium, etc.

More specifically, the dispersion resin can be produced by (1) a method of adding the polymerization initiating agent to a solution composed of the dispersion stabilizing agent, the monomer (A), and the oligomer (B), (2) a method of adding dropwise the monomer (A) and the oligomer (B) together with a polymerization initiator to a solution of the dispersion stabilizing resin, (3) a method of optionally adding a part of a mixture of the monomer (A) and the oligomer (B) together with a polymerization initiator to a solution containing a whole amount of the dispersion stabilizing resin and the remaining mixture of the monomer (A) and the oligomer (B), or (4) a method of optionally adding a solution of the dispersion stabilizing resin, the monomer (A), and the oligomer (B) together with a polymerization initiator to the nonaqueous solvent.

The total amount of the monomer (A) and the oligomer (B) is from about 5 to about 80 parts by weight, and preferably from 10 to 50 parts by weight per 100 parts by weight of the non-aqueous solvent.

The amount of the soluble resin which is the dispersion stabilizing resin for the liquid developer of this invention is from about 1 to about 100 parts by weight, and preferably from 5 to 50 parts by weight per 100 parts by weight of the total amount of the monomers.

The amount of the polymerization initiator used is typically from about 0.1 to about 5% by weight based on the total amount of the monomers.

Also, the polymerization temperature is from about 50° C. to about 180° C., and preferably from 60° C. to 120° C. The reaction time is preferably from 1 to 15 hours.

When the above-mentioned polar solvent such as alcohols, ketones, ethers, esters, etc., is used together with the non-aqueous solvent in the reaction or when the unreacted monomer (B) remains without being polymerization-granulated, it is preferred that the polar solvent or the unreacted monomer is distilled off by heating the reaction mixture to a temperature higher than the boiling point of the polar solvent or the monomer, or is distilled off under reduced pressure.

The non-aqueous dispersion resin (or non-aqueous latex grains) prepared as described above exists as fine grains having a uniform grain size distribution and, at the same time, shows a very stable dispersibility. In particular, even when the liquid developer of the invention containing the non-aqueous dispersion resin grains (or the non-aqueous latex grains) is repeatedly used for a long period of time in a development apparatus, the dispersibility of the resin in the developer is well maintained. Also, even when the developing speed is increased, the re-dispersion of the resin in the liquid developer is easy and no occurrence of stains by sticking of the resin grains to parts of the developing apparatus is observed under such a high load condition.

Also, when the resin grains are fixed by heating, a strong film is formed, which shows that the dispersion resin has an excellent fixability.

Furthermore, even when the liquid developer of this invention is used in the process of a quickened development-fix step using a master plate of a large size, the dispersion stability, the re-dispersibility, and fixability are excellent.

The reason why the re-dispersibility and the fixability of the toner images are remarkably improved as described above in the case of using the resin grains in this invention for the liquid developer has not yet been clarified. However, it has been observed that, even when the oligomer (B) was added after performing the polymerization gradulation without using the oligomer (B), the aforementioned effects were not obtained. Thus, it is considered that in the resin grains of this invention, the oligomer (B) used in the polymerization granulation improves the surface property of the resin grains.

That is, it is considered to be one of the main factors that, during the polymerization granulation carried out in a non-aqueous solvent, the specific polar group bonded only to one terminal of the main chain of the oligomer is adsorbed onto the resin grains by an anchor effect, whereby the main chain portion of the polymer improves the surface property of the resin grains to improve the affinity of the resin grains for the dispersion medium.

The liquid developer of this invention may contain, if desired, a colorant.

There is no specific restriction on the colorant being used, and any conventional pigments or dyes can be used as the colorant in this invention.

When the dispersion resin itself is to be colored, for example, a pigment or dye is physically dispersed in the dispersion resin as one method, and various kinds of pigments and dyes are known, which can be used in the method. Examples of such pigments and dyes include a magnetic iron power, a lead iodide powder, carbon black, nigrosine, alkali blue, hansa yellow, quinacridone red, and phthalocyanine blue.

As another method of coloring the liquid developer, the dispersion resin may be dyed with a desired dye, for example, as disclosed in JP-A-57-48738. As still other methods, the dispersion resin may be chemically bonded to a dye, for example, as disclosed in JP-A-53-54029; or a previously dye-containing monomer is used in polymerizing granulation to obtain a dye-containing polymer, for example, as disclosed in JP-B44-22955 (the term "JP-B" as used herein means an "examined Japanese patent publication").

Various additives may be added to the liquid developer of the present invention so as to enhance the charging characteristic or to improve the image-forming characteristic. For example, the substances described in Yuji Harasaki, *Electrophotography*, Vol. 16, No. 2, page 44 can be used for such purpose.

Specifically, useful additives include metal salts of 2-ethylhexylsulfosuccinic acid, metal salts of naphthenic acid, metal salts of higher fatty acids, lecithin, poly(vinylpyrrolidone) and copolymers containing half-maleic acid amide component.

The amounts of the main constituting components of the liquid developer of the present invention are further explained below.

The amount of the toner grains consisting essentially of a resin and a colorant is preferably from about 0.5 to about 50 parts by weight per 1000 parts by weight of the liquid carrier. If it is less than about 0.5 part by weight, the image density would be insufficient. However, if it is more than about 50 parts by weight, the non-image area would thereby be fogged. In addition, the above-mentioned liquid carrier-soluble resin for enhancing the dispersion stability may also be used, if desired, and it may be added in an amount of from about 0.5 part by weight to about 100 parts by weight, to 1000 parts by weight of the liquid carrier. The above-mentioned charge-adjusting agent is preferably used in an amount of from about 0.001 to about 1.0 part by weight per 1000 parts by weight of the liquid carrier. In addition, various additives may also be added to the liquid developer of the present invention, if desired, and the upper limit of the total amount of the additives is to be defined in accordance with the electric resistance of the liquid developer. Specifically, if the electric resistance of the liquid developer, from which to toner grains are removed, is lower than $10^9$ Ωcm, images with good continuous gradation could hardly be obtained. Accordingly, the amounts of the respective additives are required to be properly controlled within the above limitation.

Then, the following examples are intended to illustrate the embodiments of this invention in greater detail but not to limit the scope of this invention in any way.

Production Example I-1 of Oligomer: Production of Oligomer B I-1

A mixture of 100 g of methyl methacrylate, 5 g of thioglycolic acid, 150 g of toluene, and 50 g of methanol was heated to 70° C. with stirring under nitrogen gas stream and, after adding thereto 1.5 g of 2,2'-azobis-(isobutyronitrile) (A.I.B.N.), the reaction was carried out for 4 hours. Then, 0.4 g of A.I.B.N. was added thereto and the reaction was further carried out for 4 hours.

After cooling, the reaction mixture thus obtained was re-precipitated in 2 liters of a methanol/water mixture (4/1 by volume ratio), a methanol solution formed was separated by decantation, and a viscous product obtained was dried to provide 75 g of a colorless viscous product. The number average molecular weight of the polymer thus obtained was 2,800.

Production Examples I-2 to I-12 of Oligomer: Production of Oligomers B I-2 to B I-12

By following the same procedure as Production Example I-1 except that each of the mercapto compounds shown in Table 1 below was used in place of 5 g of thioglycolic acid, each of oligomers B I-2 to B I-12 was produced. The number average molecular weights of the oligomers obtained were from 2,500 to 3,500.

TABLE 1

| Production Example of Oligomer | Oligomer | Mercapto Compound | Amount |
|---|---|---|---|
| I-2 | B I-2 | $HOOC-CH_2CH_2SH$ | 5 g |
| I-3 | B I-3 | $HOOC-\underset{\underset{HOOC-CH_2}{\vert}}{CH}-SH$ | 4 g |
| I-4 | B I-4 | $HOCH_2CH_2SH$ | 3 g |
| I-5 | B I-5 | $H_2NCH_2CH_2SH$ | 3 g |
| I-6 | B I-6 | 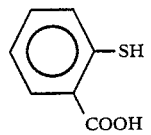 | 5 g |
| I-7 | B I-7 | 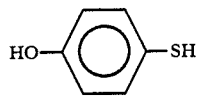 | 4.5 g |
| I-8 | B I-8 | $HO-H_2C-\underset{\underset{OH}{\vert}}{HC}-H_2C-SH$ | 3 g |
| I-9 | B I-9 | $HO-\overset{\overset{O}{\Vert}}{\underset{\underset{OH}{\vert}}{P}}-OCH_2CH_2-SH$ | 3 g |
| I-10 | B I-10 | 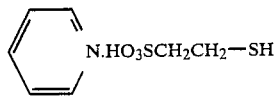 | 4 g |
| I-11 | B I-11 | $HOOC(CH_2)_2CONH(CH_2)_2SH$ | 5 g |
| I-12 | B I-12 | 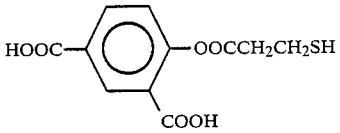 | 5 g |

Production Example I-13 to I-23 of Oligomer: Production of Oligomers B I-13 to B I-23

By following the same procedure as Production Example I-1 except that each of the monomers shown in Table 2 below was used in place of methyl methacrylate, each of oligomers B I-13 to B I-23 was produced. The number average molecular weights of the oligomers obtained were from 2,500 to 3,500.

TABLE 2

| Production Example of Oligomer | Oligomer | Monomer & Amount of Monomer | |
|---|---|---|---|
| I-13 | B I-13 | Ethyl Methacrylate | 100 g |
| I-14 | B I-14 | Propyl Methacrylate | 100 g |
| I-15 | B I-15 | Butyl Methacrylate | 100 g |
| I-16 | B I-16 | Hexyl Methacrylate | 100 g |
| I-17 | B I-17 | 2-Ethylhexyl Methacrylate | 100 g |
| I-18 | B I-18 | Dodecyl Methacrylate | 100 g |
| I-19 | B I-19 | Tridecyl Methacrylate | 100 g |
| I-20 | B I-20 | Octadecyl Methacrylate | 100 g |
| I-21 | B I-21 | Octadecyl Methacrylate | 50 g |
| | | Butyl Methacrylate | 50 g |
| I-22 | B I-22 | Butyl Methacrylate | 90 g |
| | | Styrene | 10 g |
| I-23 | B I-23 | Decyl Methacrylate | 95 g |
| | | N,N-Diethylaminoethyl Methacrylate | 5 g |

Production Example I-24 of Oligomer: Production of Oligomer B I-24

A mixture of 100 g of methyl methacrylate, 150 g of toluene, and 50 g of ethanol was heated to 75° C. with stirring under nitrogen gas stream and after adding thereto 8 g of 2,2'-azobis(cyanovaleric acid) (A.C.V.), the reaction was carried out for 4 hours. Then, 2 g of A.C.V. was added thereto and the reaction was further carried out for 4 hours. After cooling, the reaction mixture obtained was re-precipitated in 2 liters of a methanol/water mixture (4/1 by volume ratio), a methanol solution formed was separated by decantation, a viscous product obtained was dried to provide 70 g of a polymer. The number average molecular weight of the polymer was 2,600.

Production Examples I-25 to I-33 of Oligomer: Production of Oligomers B I-25 to B I-33

By following the same procedure as Production Example I-24 except that each of the azobis compounds shown in Table 3 below was used in place of the polymerization initiator, A.C.V., each of oligomers B I-25 to B I-33 was produced. The number average molecular weights of the oligomers obtained were from 2,000 to 4,000.

TABLE 3

| Production Example of Oligomer | Oligomer | R—N=N—R: Azobis Compound<br>Azobis Compound: R— |
|---|---|---|
| I-25 | B I-25 | 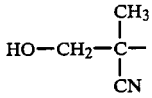 |
| I-26 | B I-26 | 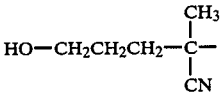 |
| I-27 | B I-27 | 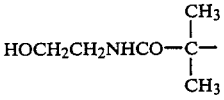 |
| I-28 | B I-28 | 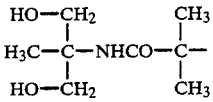 |
| I-29 | B I-29 | 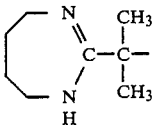 |
| I-30 | B I-30 | 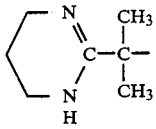 |
| I-31 | B I-31 | 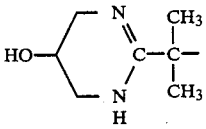 |

TABLE 3-continued

| Production Example of Oligomer | Oligomer | R—N=N—R: Azobis Compound<br>Azobis Compound: R— |
|---|---|---|
| I-32 | B I-32 | 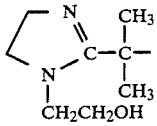 |
| I-33 | B I-33 | 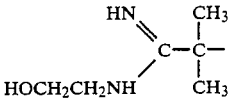 |

Production Example II-1 of Oligomer: Production of Oligomer B II-1

A mixture of 100 g of 2,3-diacetoxypropyl methacrylate, 5 g of 3-mercaptopropionic acid, 150 g of toluene, and 50 g of methanol was heated to 70° C. with stirring under nitrogen gas stream and after adding thereto 1.5 g of 2,2'-azobis(isobutyronitrile) (A.I.B.N.), the reaction was carried out for 4 hours. Then, 0.4 g of A.I.B.N. was added thereto and the reaction was further carried out for 4 hours. After cooling, the reaction mixture was re-precipitated in 2 liters of a methanol/water mixture (4/1 by volume ratio), a methanol solution formed was separated by decantation and the viscous product obtained was dried to provide 75 g of a colorless viscous product. The number average molecular weight of the polymer obtained was 3,300.

The Polymer, oligomer B II-1 has been confirmed to have the following structure.

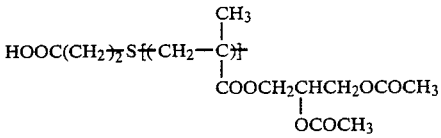

Examples II-2 to II-13 of Oligomer: Production of Oligomers B II-2 to B II-13

By following the same procedure as Production Example II-1 except that each of the mercapto compounds shown in Table 4 below was used in place of 5 g of 3-mercaptopropionic acid, each of oligomers B II-2 to B II-13 was produced. The number average molecular weights of the oligomers obtained were from 2,500 to 5,000.

TABLE 4

| Production Example of Oligomer | Oligomer | Mercpato Compound | Amount |
|---|---|---|---|
| II-2 | B II-2 | $HOOC—CH_2—SH$ | 5 g |
| II-3 | B II-3 | $HOOC—CH(HOOC—CH_2)—SH$ | 4 g |
| II-4 | B II-4 | $HOCH_2CH_2SH$ | 3 g |
| II-5 | B II-5 | $H_2NCH_2CH_2SH$ | 3 g |

TABLE 4-continued

| Production Example of Oligomer | Oligomer | Mercpato Compound | Amount |
|---|---|---|---|
| II-6 | B II-6 | 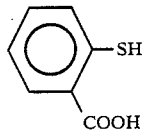 | 5 g |
| II-7 | B II-7 | 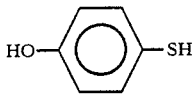 | 4.5 g |
| II-8 | B II-8 | $HO-H_2C-\underset{\underset{OH}{\vert}}{HC}-H_2C-SH$ | 3 g |
| II-9 | B II-9 | $HO-\overset{\overset{O}{\Vert}}{\underset{\underset{OH}{\vert}}{P}}-OCH_2CH_2-SH$ | 3 g |
| II-10 | B II-10 | 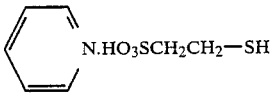 | 4 g |
| II-11 | B II-11 | $HOOC(CH_2)_2CONH(CH_2)_2SH$ | 5 g |
| II-12 | B II-12 | 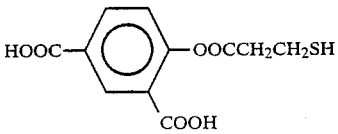 | 5 g |
| II-13 | B II-13 | 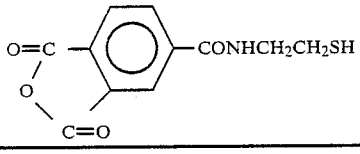 | 6 g |

Production Examples II-14 to II-33 of Oligomer: Production of Oligomers B II-14 to B II-33

By following the same procedure as Production Example II-1 except that each of the monomers shown in Table 5 below was used in place of 2,3-diacetoxypropyl methacrylate, each of oligomers B II-14 to B II-33 was produced. The number average molecular weights of the oligomers obtained were from 2,500 to 3,500.

TABLE 5

$$HOOC\text{-}(CH_2)_2S\text{-}[(CH_2-\underset{\underset{COO-R}{\vert}}{\overset{\overset{CH_3}{\vert}}{C}})]\text{-}$$

| Production Example of Oligomer | Oligomer | —R |
|---|---|---|
| II-14 | B II-14 | $-(CH_2)_2OCOCH_3$ |
| II-15 | B II-15 | $-(CH_2)_2OCOC_4H_9$ |
| II-16 | B II-16 | $-(CH_2)_2OCOC_9H_{19}$ |
| II-17 | B II-17 | $-(CH_2)_2OCO(CH_2)_2COOC_2H_5$ |
| II-18 | B II-18 | $-(CH_2)_2OCO(CH_2)_3COOCH_3$ |
| II-19 | B II-19 | $-(CH_2)_2OCOCH{=}CH-COOC_5H_{11}$ |

TABLE 5-continued $$HOOC\text{-}(CH_2)_2S\text{-}[(CH_2-\underset{\underset{COO-R}{\vert}}{\overset{\overset{CH_3}{\vert}}{C}})]\text{-}$$

| Production Example of Oligomer | Oligomer | —R |
|---|---|---|
| II-20 | B II-20 | $-CH_2\underset{\underset{OH}{\vert}}{CH}CH_2OOCC_3H_7$ |
| II-21 | B II-21 | $-CH_2\underset{\underset{OH}{\vert}}{CH}CH_2OOCC_5H_{11}$ |
| II-22 | B II-22 | $-CH_2\underset{\underset{OCOCH_3}{\vert}}{CH}CH_2OCOCH_3$ |
| II-23 | B II-23 | $-CH_2\underset{\underset{OCOC_3H_7}{\vert}}{CH}CH_2OCOC_3H_7$ |
| II-24 | B II-24 | $-CH_2\underset{\underset{OCOC_5H_{11}}{\vert}}{CH}CH_2OCOC_5H_{11}$ |

TABLE 5-continued $$HOOC\text{-}(CH_2)_2\text{-}S\text{-}[(CH_2\text{-}C(CH_3)(COO\text{-}R))]$$

| Production Example of Oligomer | Oligomer | —R |
|---|---|---|
| II-25 | B II-25 | $-CH_2CH(OCOC_6H_{13})CH_2OCOC_6H_{13}$ |
| II-26 | B II-26 | $-CH_2CH(OCOCH_3)CH_2OCOC_5H_{11}$ |
| II-27 | B II-27 | $-CH_2CH(OH)CH_2OOC(CH_2)_2COOC_3H_7$ |
| II-28 | B II-28 | $-CH_2CH(OH)CH_2OOC(CH_2)_3COOCH_3$ |
| II-29 | B II-29 | $-CH_2CH(OCOCH_3)CH_2OOC(CH_2)_3COOC_3H_7$ |
| II-30 | B II-30 | $-CH(COOCH_3)-CH_2COOCH_3$ |
| II-31 | B II-31 | $-(CH_2)_2OCO(CH_2)_2SO_2C_4H_9$ |
| II-32 | B II-32 | $-(CH_2)_2OCO(CH_2)_2SO_2C_8H_{17}$ |
| II-33 | B II-33 | $-(CH_2)_6OCOC_2H_5$ |

Production Example II-34 of Oligomer: Production of Oligomer B II-34

A mixture of 100 g of 2-(n-octylcarbonyloxy)ethyl crotonate, 150 g of toluene, and 50 g of ethanol was heated to 75° C. with stirring under nitrogen gas stream and after adding thereto 8 g of 2,2'-azobis(cyanovaleric acid) (A.C.V.), the reaction was carried out for 5 hours. Then, 2 g of A.C.V. was added thereto and the reaction was further carried out for 4 hours. After cooling, the reaction mixture obtained was reprecipitated in 2 liters of a methanol/water mixture (4/1 by volume ratio), the methanol solution formed was separated by decantation, and the viscous product formed was dried to provide 70 g of a polymer product. The number average molecular weight of the polymer obtained was 2,600.

The product, oligomer B II-34, was confirmed to have the following structure.

Oligomer B II-34:

$$HOOC\text{-}(CH_2)_2\text{-}C(CH_3)(CN)\text{-}[(CH(CH_3)\text{-}CH(COO(CH_2)_2OCOC_9H_{19}(n)))]$$

Production Examples II-35 to II-43 of Oligomer: Production of Oligomers B II-35 to B II-43

By following the same procedure as Production Example II-34 except that each of the azobis compounds shown in Table 6 below was used in place of the polymerization initiator, A.C.V., each of oligomers B II-35 to B II-43 was produced. The number average molecular weights of the oligomers obtained were from 2,000 to 4,000.

TABLE 6

R—N=N—R: Azobis Compound

| Production Example of Oligomer | Oligomer | Azobis Compound: R— |
|---|---|---|
| II-35 | B II-35 | $HO-CH_2-C(CH_3)(CN)-$ |
| II-36 | B II-36 | $HO-CH_2CH_2CH_2-C(CH_3)(CN)-$ |
| II-37 | B II-37 | $HOCH_2CH_2NHCO-C(CH_3)(CH_3)-$ |
| II-38 | B II-38 | $(HO-CH_2)(H_3C)C-NHCO-C(CH_3)(CH_3)-$ |
| II-39 | B II-39 | 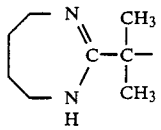 |
| II-40 | B II-40 | 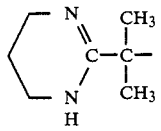 |
| II-41 | B II-41 | 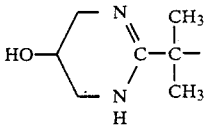 |
| II-42 | B II-42 | 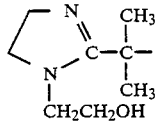 |
| II-43 | B II-43 | $HOCH_2CH_2NH(HN)C-C(CH_3)(CH_3)-$ |

Production Example 1 of Latex Grains: Production of Latex D-1

A mixture of 20 g of poly(octadecyl methacrylate), 100 g of vinyl acetate, 1.0 of the oligomer B I-1, and 380 g of Isopar H was heated to 70° C. under nitrogen gas stream and after adding thereto 0.8 g of 2,2'-azobis(valeronitrile) (A.B.V.N.), the reaction was carried out for 6 hours. Twenty minutes after the addition of the polymerization initiator, the reaction mixture became white turbid and the reaction temperature raised to 88° C. Then, the temperature of the system was raised to 100° C. and the reaction mixture was stirred for 2 hours to distil off unreacted vinyl acetate. After cooling, the reaction mixture was passed through a 200 mesh nylon cloth to provide a latex having a mean grain size of 0.24

μm with a polymerization ratio of 88% as a white dispersion.

Production Examples 2 to 21 of Latex Grains:

Production of Latexes D-2 to D-21

By following the same procedure as Production Example 1 of latex grains except that each of the oligomers shown in Table 7 below was used in place of the oligomer B I-1, each of white dispersions (latexes) was obtained. The polymerization ratios of the white dispersions were from 85% to 90%. Also, the mean grain sizes of the latexes obtained were from 0.23 μm to 0.27 μm.

TABLE 7

| Production Example of Latex | Latex | Oligomer |
|---|---|---|
| 2 | D-2 | B I-2 |
| 3 | D-3 | B I-3 |
| 4 | D-4 | B I-4 |
| 5 | D-5 | B I-5 |
| 6 | D-6 | B I-6 |
| 7 | D-7 | B I-7 |
| 8 | D-8 | B I-8 |
| 9 | D-9 | B I-9 |
| 10 | D-10 | B I-10 |
| 11 | D-11 | B I-11 |
| 12 | D-12 | B I-12 |
| 13 | D-13 | B I-13 |
| 14 | D-14 | B I-14 |
| 15 | D-15 | B I-16 |
| 16 | D-16 | B I-17 |
| 17 | D-17 | B I-18 |
| 18 | D-18 | B I-20 |
| 19 | D-19 | B I-21 |
| 20 | D-20 | B I-23 |
| 21 | D-21 | B I-24 |

Production Examples 22 to 35 of Latex Grains: Production of Latexes D-22 to D-35

By following the same procedure as Production Example 1 of latex grains except that each of the dispersion stabilizing resins and each of the oligomers described in Table 8 below were used in place of the dispersion stabilizing resin, poly(octadecyl methacrylate) and the oligomer B I-1, each of white dispersions was obtained. The polymerization ratios of the dispersions obtained were from 85% to 90%.

TABLE 8

| Production Example of Latex | Latex | Dispersion Stabilizing Resin (copolymerization ratio by weight) and Amount | | Oligomer and Amount | | Average Grain Size of Latex (μm) |
|---|---|---|---|---|---|---|
| 22 | D-22 | Poly(dodecyl methacrylate) | 18 g | B-I-1 | 1.0 g | 0.24 |
| 23 | D-23 | Poly(tridecyl methacrylate) | 19 g | B I-1 | 1.0 g | 0.24 |
| 24 | D-24 | Poly(hexadecyl methacrylate) | 20 g | B-I-1 | 1.0 g | 0.26 |
| 25 | D-25 | Poly(docosanyl methacrylate) | 20 g | B-I-1 | 1.0 g | 0.28 |
| 26 | D-26 | Octadecyl methacrylate/decyl methacrylate Copolymer (70/30) | 20 g | B I-24 | 1.0 g | 0.26 |
| 27 | D-27 | Dodecyl methacrylate/Butyl methacrylate Copolymer (80/20) | 18 g | B I-26 | 1.0 g | 0.23 |
| 28 | D-28 | Poly(dodecyl methacrylate) | 16 g | B I-8 | 1.2 g | 0.23 |
| 29 | D-29 | Octadecyl methacrylate/ Methacrylate acid Copolymer (95/5) | 16 g | B I-2 | 0.8 g | 0.24 |
| 30 | D-30 | Hexadecyl methacrylate/ Acrylamide Copolymer (96/4) | 15 g | B I-28 | 0.8 g | 0.27 |
| 31 | D-31 | Dodecyl methacrylate/ 2-Chloromethyl methacrylate Copolymer (92/8) | 16 g | B I-29 | 0.9 g | 0.25 |
| 32 | D-32 | Octadecyl methacrylate/N,N-Dimethylaminoethyl methacrylate Copolymer (95/5) | | B I-30 | 1.0 g | 0.27 |
| 33 | D-33 | Octadecyl methacrylate/2-Ethylhexyl methacrylate Copolymer (80/20) | | B I-31 | 0.6 g | 0.24 |
| 34 | D-34 | Octadecyl Methacrylate/2-Hydroxyethyl methacrylate Copolymer (95/5) | | B I-33 | 0.5 g | 0.25 |
| 35 | D-35 | Poly(octadecyl methacrylate) | | B I-1 | 0.5 g | 0.26 |

Production Example 36 of Latex Grains: Production of Latex D 36

A mixture of 20 g of poly(octadecyl methacrylate), 100 g of vinyl acetate, 5 g of crotonic acid, 1.0 g of the oligomer B I-3, and 468 g of Isopar E was heated to 70° C. with stirring under nitrogen gas stream and after adding thereto 0.7 g of A.B.V.N., the reaction was carried out for 6 hours. Thereafter, the temperature of the system was raised to 100° C. and the reaction mixture was stirred for one hour at the temperature to distil off remaining vinyl acetate. After cooling, the reaction mixture obtained was passed through a 200 mesh nylon cloth to provide a latex having a mean grain size of 0.23 μm with a polymerization ratio of 85% as a white dispersion.

Production Example 37 of Latex Grains: Production of Latex D-37

A mixture of 20 g of poly(dodecyl methacrylate), 100 g of vinyl acetate, 6.0 g of 4-pentenic acid, 0.8 g of the oligomer B I-15, and 380 g of Isopar G was heated to 70° C. with stirring under nitrogen gas stream and after adding thereto 0.7 g of benzoyl peroxide, the reaction was carried out for 4 hours. Then, 0.5 g of benzoyl peroxide was added thereto and the reaction was further carried out for 2 hours. After cooling, the reaction mixture obtained was passed through a 200 mesh nylon to provide a latex having a mean grain size of 0.24 μm as a white dispersion.

Production Example 38 of Latex Grains: Production of Latex D-38

A mixture of 85 g of vinyl acetate, 15 g of N-vinylpyrrolidone, 1.2 g of the oligomer B I-9, and 380 g of n-decane was heated to 75° C. with stirring under nitrogen gas stream and after adding thereto 7 g of A.I.B.N., the reaction was carried out for 4 hours. Then, 0.5 g of A.I.B.N. was added thereto and the reaction was further carried out for 2 hours. After cooling, the reaction mixture obtained was passed through a 200 mesh nylon cloth to provide a latex having a mean grain size of 0.20 μm as a white dispersion.

Production Example 39 of Latex Grains: Production of Latex D-39

A mixture of 20 g of poly(octadecyl methacrylate), 100 g of methyl methacrylate, 1.0 g of the oligomer B I-19, and 470 g of n-decane was heated to 70° C. with stirring under nitrogen gas stream and after adding 1.0 g of A.I.B.N., the reaction was carried out for 2 hours. Few minutes after the addition of the polymerization initiator, the reaction mixture began to become blue-white turbid and the reaction temperature raised to 90° C. After cooling, the reaction mixture was passed through a 200 mesh nylon cloth to remove coarse grains, thereby a latex having a mean grain size of 0.45 μm was obtained as a white dispersion.

Production Example 40 of Latex Grains: (Comparison Example A)

By following the same procedure as Production Example 1 of latex grains except that the oligomer B I-1 was not used, a latex having a mean grain size of 0.25 μm with a polymerization ratio of 85% was obtained as a white dispersion.

Production Example 41 of Latex Grains: (Comparison Example B)

By following the same procedure as Production Example 1 of latex grains except that a mixture of 18 g of poly(octadecyl methacrylate), 100 g of vinyl acetate, 1.0 g of octadecyl methacrylate, and 385 g of Isopar H was used, a latex having a mean grain size of 0.22 μm with a polymerization ratio of 85% was obtained as a white dispersion.

Production Example 42 of Latex Grains: (Comparison Example C)

By following the same procedure as Production Example 1 of latex grains except that a mixture of 18 g of poly(octadecyl methacrylate), 100 g of vinyl acetate, 1 g of a monomer (I) having the following chemical structure, and 385 g of Isopar H was used, a latex having a mean grain size of 0.24 μm with a polymerization ratio of 86% was obtained as a white dispersion.

Monomer (I):

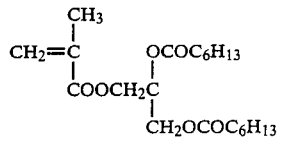

Production Example 43 of Latex Grains: Production of Latex D-43

A mixture of 20 g of poly(octadecyl methacrylate), 100 g of vinyl acetate, 1.0 g of the oligomer B II-16, and 380 g of Isopar H was heated to 70° C. with stirring under nitrogen gas stream and after adding thereto 0.8 g of 2,2'-azobis(isovaleronitrile) (A.I.V.N.), the reaction was carried out for 2 hours. Then, 0.3 g of A.I.V.N. was added thereto and the reaction was further carried out for 2 hours. Twenty minutes after the addition of the polymerization initiator, the reaction mixture became white turbid and the reaction temperature raised to 88° C. The temperature of the system was raised to 100° C. and the reaction mixture was stirred to distil off unreacted vinyl acetate. After cooling, the reaction mixture was passed through a 200 mesh nylon cloth to provide a latex having a mean grain size of 0.24 μm with a polymerization ratio of 88% as a white dispersion.

Production Examples 44 to 72 of Latex Grains: Production of Latexes D-44 to D-72

By following the same procedure as Production Example 43 of latex grains except that each of the dispersion stabilizing resins and each of the oligomers shown in Table 9 below were used in the dispersion stabilizing resin and the oligomer in the example, each of latex grains was produced. The polymerization ratios of the latex grains thus obtained were from 80% to 85%.

TABLE 9

| Production Example of Latex | Latex | Dispersion Stabilizing Resin (copolymerization ratio by weight) and Amount | | Oligomer and Amount | | Average Grain Size of Latex |
|---|---|---|---|---|---|---|
| 44 | D-44 | Poly(Dodecyl methacrylate) | 18 g | B II-1 | 1.0 g | 0.23 μm |
| 45 | D-45 | Poly(tridecyl methacrylate) | 20 g | B II-1 | 1.0 g | 0.24 μm |
| 46 | D-46 | Poly(tetradecyl methacrylate) | 20 g | B II-3 | 0.8 g | 0.22 μm |
| 47 | D-47 | Poly(hexadecyl methacrylate) | 18 g | B II-1 | 1.0 g | 0.23 μm |
| 48 | D-48 | Poly(octadecyl methacrylate) | 18 g | B II-17 | 1.0 g | 0.23 μm |
| 49 | D-49 | Octadecyl methacrylate/ methacrylic Acid Copolymer (95/5) | 16 g | B II-19 | 0.8 g | 0.21 μm |
| 50 | D-50 | Dodecyl methacrylate/ Acrylic Acid Copolymer (96/4) | 14 g | B II-21 | 0.6 g | 0.20 μm |
| 51 | D-51 | Octadecyl methacrylate/2-N,N'-dimethyl-amino)ethyl methacrylate copolymer (97/3) | 12 g | B II-22 | 1.0 g | 0.23 μm |
| 52 | D-52 | Tridecyl methacrylate/2-Chloroethyl Methacrylate Copolymer (94/6) | 18 g | B II-25 | 2.0 g | 0.25 μm |
| 53 | D-53 | Octadecyl methacrylate/2-phosphonoethyl-methacrylate copolymer (95/5) | 12 g | B II-30 | 1.0 g | 0.23 μm |
| 54 | D-54 | Octadecyl methacrylate/octyl methacrylate copolymer (6/4) | 18 g | B II-26 | 0.8 g | 0.24 μm |
| 55 | D-55 | Dodecyl methacrylate/t-butyl methacrylate copolymer (9.1) | 20 g | B II-24 | 1.0 g | 0.21 μm |
| 56 | D-56 | Tridecyl methacrylate/trifluoro methacrylate copolymer (85/15) | 16 g | B II-35 | 1.2 g | 0.21 μm |
| 57 | D-57 | Dodecyl methacrylate/styrene copolymer (85/15) | 18 g | B-II-36 | 1.0 g | 0.25 μm |

TABLE 9-continued

| Production Example of Latex | Latex | Dispersion Stabilizing Resin (copolymerization ratio by weight) and Amount | | Oligomer and Amount | | Average Grain Size of Latex |
|---|---|---|---|---|---|---|
| 58 | D-58 | Dodecyl methacrylate/2-hydroxypropyl copolymer (95/5) | 12 g | B II-38 | 1.5 g | 0.19 μm |
| 59 | D-59 | Dodecyl methacrylate/acrylamide copolymer (95/5) | 10 g | B II-39 | 0.7 g | 0.20 μm |
| 60 | D-60 | Octadecyl methacrylate/2-cyano-ethyl methacrylate copolymer (9/1) | 18 g | B II-34 | 1.2 g | 0.22 μm |
| 61 | D-61 | Octadecyl methacrylate/2-morpholino-ethyl methacrylate copolymer (95/5) | 16 g | B II-41 | 1.3 g | 0.19 μm |
| 62 | D-62 | Toughtec M-1911 (tradename, made by Asahi Chemical Industry Co.) | 15 g | B II-24 | 1.3 g | 0.18 μm |
| 63 | D-63 | Toughtec M-1943 (tradename, made by Asahi Chemical Industry Co.) | 8 g | B II-9 | 1.5 g | 0.15 μm |
| 64 | D-64 | Poly(octadecyl methacrylate) | 20 g | B II-14 | 0.8 g | 0.25 μm |
| 65 | D-65 | Poly(octadecyl methacrylate) | 20 g | B II-18 | 1.0 g | 0.25 μm |
| 66 | D-66 | Poly(octadecyl methacrylate) | 20 g | B II-29 | 1.5 g | 0.26 μm |
| 67 | D-67 | Dodecyl methacrylate/Vinyl acetate copolymer (9/1) | 16 g | B II-10 | 0.5 g | 0.23 μm |
| 68 | D-68 | Octadecyl methacrylate/2-carboxy-ethyl acrylate copolymer (95/5) | 14 g | B II-10 | 0.8 g | 0.22 μm |
| 69 | D-69 | Dodecyl methacrylate/Itaconic Anhydride copolymer (96/4) | 13 g | B II-13 | 1.0 g | 0.19 μm |
| 70 | D-70 | Poly(dodecyl methacrylate) | 18 g | B II-5 | 1.4 g | 0.22 μm |
| 71 | D-71 | Poly(dodecyl methacrylate) | 18 g | B II-6 | 2.0 g | 0.21 μm |
| 72 | D-72 | Poly(tridecyl methacrylate) | 20 g | B II-22 | 0.8 g | 0.23 μm |

Production Example 73 of Latex Grains: Production of Latex D-73

A mixture of 20 g of poly(octadecyl methacrylate), 100 g of vinyl acetate, 5 g of crotonic acid, 1.5 g of the oligomer B II-3, and 468 g of Isopar E was heated to 70° C. with stirring under nitrogen gas stream and after adding thereto 1.3 g of A.I.V.N., the reaction was carried out for 6 hours. Then, the temperature of the system was raised to 100° C. and the reaction mixture was stirred at the temperature for one hour to distil off remaining vinyl acetate. After cooling, the reaction mixture was passed through a 200 mesh nylon cloth to provide a latex having a mean grain size of 0.23 μm with a polymerization ratio of 85% as a white dispersion.

Production Example 74 of Latex Grains: Production of Latex D-74

A mixture of 20 g of poly(dodecyl methacrylate), 100 g of vinyl acetate, 6.0 g of 4-pentenic acid, 1.0 g of the oligomer B II-13, and 380 g of Isopar G was heated to 75° C. with stirring under nitrogen gas stream and after adding thereto 0.7 g of A.I.B.N., the reaction was carried out for 4 hours. Then, 0.5 g of A.I.B.N was added thereto and the reaction was further carried out for 2 hours. After cooling, the reaction mixture was passed through a 200 mesh nylon cloth to provide a latex a mean grain size of 0.24 μm as a white dispersion.

Production Example 75 of Latex Grains: Production of Latex D-75

A mixture of 18 g of a dodecyl methacrylate/2-hydroxyehyl methacrylate copolymer (8/2 by mole ratio), 85 g of vinyl acetate, 15 g of N-vinylpyrrolidone, 1.2 g of the oligomer B II-39, and 380 g of n-decane was heated to 75° C. with stirring under nitrogen gas stream and after adding thereto 1.7 g of A.I.B.N., the reaction was carried out for 4 hours. Then, 0.5 g of A.I.B.N. was added thereto and the reaction was further carried out for 2 hours. After cooling, the reaction mixture was passed through a 200 mesh nylon cloth to provide a latex having a mean grain size of 0.20 μm as a white dispersion.

Production Example 76 of Latex Grains: Production of Latex D-76

A mixture of 20 g of poly(octadecyl methacrylate), 100 g of isopropyl methacrylate, 1.0 g of the oligomer B II-15, and 470 g of n-decane was heated to 70° C. with stirring under nitrogen gas stream and after adding thereto 1.0 g of A.I.V.N., the reaction was carried out for 2 hours. After few minutes since the addition of the polymerization initiator, the reaction mixture became blue-white turbid and the reaction temperature raised to 90° C. After cooling, the reaction mixture was passed through a 200 mesh nylon cloth to remove coarse grains, thereby a latex having a mean grain size of 0.45 μm was obtained as a white dispersion.

Production Example 77 of Latex Grains: Production of Latex D-77

A mixture of 25 g of poly(dodecyl methacrylate), 100 g of styrene, 0.6 g of the oligomer B II-19, and 380 g of Isopar H was heated to 60° C. with stirring under nitrogen gas stream and after adding thereto 0.6 g of A.I.V.N., the reaction was carried out for 4 hours. Then, 0.3 g of A.I.V.N. was added thereto and the reaction was further carried out for 3 hours. After cooling, the reaction mixture was passed through a 200 mesh nylon cloth to provide a latex having a mean grain size of 0.28 μm as a white dispersion.

Production Example 78 of Latex Grains: (Comparison Example D)

By following the same procedure as Production Example 43 of latex grains except that the oligomer B II-16 was not used, a latex having a mean grain size of 0.25 μm with a polymerization ratio of 85% was obtained as a white dispersion.

Production Example 79 of Latex Grains: (Comparison Example E)

By following the same procedure as Production Example 43 of latex grains except that a mixture of 18 g of poly(octadecyl methacrylate), 100 g of vinyl acetate, 1.0 g of octadecyl methacrylate, and 385 g of Isopar H was used, a latex having a mean grain size of 0.22 μm with a polymerization ratio of 85% was obtained as a white dispersion. (The product corresponds to the latex of JP-A-60-179751).

Production Example 80 of Latex Grains: (Comparison Example F)

By following the same procedure as Production Example 43 of latex grains except that a mixture of 18 g of poly(octadecyl methacrylate), 100 g of vinyl acetate, 1 g of a monomer (J) having the following chemical structure, and 385 g of Isopar H was used, a latex having a mean grain size of 0.24 μm with a polymerization ratio of 86% was obtained as a white dispersion. (The product corresponds to the latex of JP-A-62-151868).

Monomer (J):

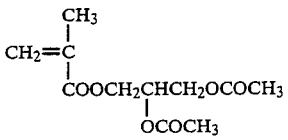

EXAMPLE 1

In a paint shaker (manufactured by Tokyo Seiki K.K.) were placed 10 g a dodecyl methacrylate/acrylic acid copolymer (95/5 by weight ratio), 10 g of nigrosine and 30 g of Shellsol 71 together with glass beads and they were dispersed for 4 hours to provide a fine dispersion of nigrosine.

Then, a liquid developer for electrostatic photography was prepared by diluting 30 g of Latex D-1 obtained in Production Example 1 of latex grains, 2.5 g of the aforesaid nigrosine dispersion, and 0.08 g of a copolymer of octadecene and semi-maleic octadecylamide with one liter of Shellsol 71.

Comparison Liquid Developer A, B, and C

Three kinds of comparison liquid developers A, B, and C were prepared in the same manner as above except that the latexes shown below were used in place of the latex D-1 used above.

Comparison Liquid Developer A

The latex obtained in Production Example 41 of latex grains was used.

Comparison Liquid Developer B

The latex obtained in Production Example 41 of latex grains was used.

Comparison Liquid Developer C

The latex obtained in Production Example 42 of latex grains was used.

An electrophotographic light-sensitive material, ELP Master II Type (trade name, made by Fuji Photo Film Co., Ltd.) was image-exposed and developed by a fullautomatic processor, ELP 404V (trade name, made by Fuji Photo Film Co., Ltd.) using each of the liquid developers thus prepared. The processing (plate-making) speed was 5 plates/minute. Furthermore, after processing 2,000 plates of ELP Master II Type, the occurrence of stains of the developing apparatus by sticking of the toner was observed. The blackened ratio (imaged area) of the duplicated images was determined using 20% original. The results obtained are shown in Table 10 below.

TABLE 10

| Test No. | Liquid Developer | Stains of Developing Apparatus | Image of the 2,000th Plate |
|---|---|---|---|
| 1 | Developer of Example 1 | No toner residue adhered | Clear |
| 2 | Developer A | Toner residue greatly adhered | Letter part lost, density of solid black lowered, background portion fogged |
| 3 | Developer B | Toner residue adhered slightly | Density of fine lines slightly lowered, Dmax lowered |
| 4 | Developer C | Toner residue adhered | Density of fine lines slightly lowered, Dmax lowered |

As is clear from the results shown above, when printing plates were produced by the aforesaid processing condition using each liquid developer, the liquid developer of this invention only caused no stains of the developing apparatus and give clear images of the 2,000th plate.

Then, the offset printing master plate (ELP Master) prepared by processing using each of the liquid developers was used for printing in a conventional manner, and the number of prints obtained before occurrences of defects of letters on the images of the print, the lowering of the density of the solid black portions of the image, etc., was checked. The results showed that the master plate obtained by using each of the liquid developer of this invention and the liquid developers of Comparison Examples A and C gave more than 10,000 prints without accompanied by the aforesaid failures, while the master plate prepared using the developer of Comparison Example B resulted in the failures after 8,000 prints.

As is clear from the aforesaid results, only the liquid developer of this invention could advantageously be used for preparing a large number of prints by the master plate without causing stains of the developing apparatus.

In the case of using Comparison Liquid Developer A, there was no problem on the number of prints but the developing apparatus was too stained to further use continuously.

Also, in the cases of Comparison Liquid Developers B and C, the developing apparatus was stained (in particular, on the back surface of the electrode plate) when the developer was used under the condition of a rapid processing speed as 5 plates/minute (an ordinary processing speed was 2 or 3 plates/minute) and after the formation of about 2,000 plates, the image quality of the duplicated images of the plate was reduced (the reduction of Dmax, lowering of the density of fine lines, etc.). There was no problem on the number of prints by the master plate in the case of using the Comparison Liquid Developer C but the number thereof was lowered in the case of using the Comparison Liquid Developer B.

These results show that the resin grains of this invention are clearly excellent.

EXAMPLE 2

A mixture of 100 g of the white dispersion (latex grains) obtained in Production Example 2 of latex grains and 1.5 g of Sumikalon Black was heated to 100° C. with stirring for 4 hours. After cooling to room temperature, the reaction mixture was passed through a 200 mesh nylon cloth to remove the remaining dye, whereby a black resin dispersion having a mean grain size of 0.23 μm was obtained.

A liquid developer was prepared by diluting 32 g of the aforesaid black resin dispersion, 0.05 g of zirconium naphthenate, and 15 g of a higher alcohol, FOC-1400 (trade name, made by Nissan Chemical Industries, Ltd.), with one liter of Shellsol 71.

When the liquid developer was applied to the same developing apparatus as in Example 1, no occurrence of stains of the developing apparatus by sticking of the toner was observed even after developing 2,000 plates.

Also, the quality of the offset printing master plate obtained was clear and also the image quality of the 10,000 print formed using the maser plate was very clear.

EXAMPLE 3

A mixture of 100 g of the white dispersion obtained in Production Example 36 of latex grains and 3 g of Victoria Blue was heated to a temperature of from 70° C. to 80° C. with stirring for 6 hours. After cooling to room temperature, the reaction mixture was passed through a 200 mesh nylon cloth to remove the remaining dye, whereby a blue resin dispersion having a mean grain size of 0.24 μm was obtained.

A liquid developer was prepared by diluting 32 g of the aforesaid blue resin dispersion, 0.05 g of zirconium naphthenate, and 15 g of a higher alcohol, FOC-1600 (trade name, made by Nissan Chemical Industries, Ltd.), with one liter of Isopar H.

When the liquid developer was applied to the same developing apparatus as in Example 1, no occurrence of stains of the developing apparatus by sticking of the toner was observed even after developing 2,000 plates. Also, the image quality of the offset printing master plate obtained was clear and also the image quality of the 10,000th print was very clear.

EXAMPLE 4

A liquid developer was prepared by diluting 32 g of the white resin dispersion obtained in Production Example 3 of latex grains, 2.5 g of the nigrosine dispersion obtained in Example 1, and 0.02 g of a semidocosanylamidated product of a copolymer of diisobutyrene and maleic anhydride with one liter of Isopar G.

When the liquid developer was applied to the same developing apparatus as in Example 1, no occurrence of stains of the developing apparatus by sticking of the toner was observed even after developing 2,000 plates. Also, the image quality of the offset printing master plate obtained and the image quality of the 10,000th print obtained using the master plate were very clear.

Furthermore, when the same processing as above was applied after allowing to stand the liquid developer for 3 months, the results were same as above.

EXAMPLE 5

In a paint shaker were placed 10 g of poly(decyl methacrylate), 30 g of Isopar H, and 8 g of Alkali Blue together with glass beads followed by dispersing for 2 hours to provide a fine dispersion of Alkali Blue.

A liquid developer was prepared by diluting 30 g of the white resin dispersion D-13 obtained in Production Example 13 of latex grains, 4.2 g of the aforesaid Alkali Blue dispersion, 0.06 g of a semidocosanylaminated product of a copolymer of octadecyl vinyl ether and maleic anhydride, and 15 g of a higher alcohol, FOC-1400, with one liter of Isopar G.

When the liquid developer was applied to the same developing apparatus as in Example 1, no occurrence of stains of the developing apparatus by sticking of the toner was observed even after developing 2000 plates. Also, the image quality of the offset printing master plate obtained and the image quality of the 10,000th print obtained using the master plate were very clear.

EXAMPLES 6 TO 26

By following the same procedure as Example 5 except that each of the resin dispersions of this invention shown in Table 11 below was used in place of the resin dispersion D-13, each of liquid developers was prepared.

TABLE 11

| Example | Resin Dispersion | Example | Resin Dispersion |
|---|---|---|---|
| 6 | D-4 | 17 | D-16 |
| 7 | D-5 | 18 | D-17 |
| 8 | D-6 | 19 | D-18 |
| 9 | D-7 | 20 | D-22 |
| 10 | D-8 | 21 | D-25 |
| 11 | D-9 | 22 | D-28 |
| 12 | D-10 | 23 | D-29 |
| 13 | D-11 | 24 | D-32 |
| 14 | D-12 | 25 | D-34 |
| 15 | D-14 | 26 | D-35 |
| 16 | D-15 | | |

When each of the liquid developers was applied to the same developing apparatus as in Example 1, no occurrence of stains of the developing apparatus by sticking of the toner was observed even after developing 2,000 plates. Also, the image quality of the offset printing masters obtained and the image quality of the 10,000th print obtained using each of the master plates were very clear.

EXAMPLE 27

In a paint shaker (manufactured by Tokyo Seiki K.K.) were placed 10 g of a dodecyl methacrylate/acrylic acid copolymer (95/5 by weight ratio), 10 g of nigrosine and 30 g of Shellsol 71 together with glass beads followed by dispersing for 4 hours to provide a fine dispersion of nigrosine.

A liquid developer was prepared by diluting 30 g of the resin dispersion D-43 obtained in Production Example 43 of latex grains, 2.5 g of the aforesaid nigrosine dispersion, 15 g of a higher alcohol, FOC-1400 (trade name, made by Nissan Chemical Industries, Ltd., tetradecyl alcohol), and 0.08 g of a copolymer of octadecene and semi-maleic octadecylamide, with one liter of Shellsol 71.

Comparison Liquid Developers D, E, and F:

Three kinds of Comparison Liquid Developers D, E, and F were prepared using the following resin dispersions in the above-described production method.

Comparison Liquid Developer D:

The resin dispersion obtained in Production Example 78 of latex grains was used.

Comparison Liquid Developer E:

The resin dispersion obtained in Production Example 78 of latex grains was used.

Comparison Liquid Developer F:

The resin dispersion obtained in Production Example 80 of latex grains was used.

An electrophotographic light-sensitive material, ELP Master II Type (trade name, made by Fuji Photo Film Co., Ltd.) was image exposed and developed by a fullautomatic processor, ELP 404V (trade name, made by Fuji Photo Film Co., Ltd.) using each of the liquid developers. The processing speed (plate-making speed) was 5 plates/minute. Furthermore, the occurrence of stains of the developing apparatus by sticking of the toner after processing 2,000 plates of ELP Master II Type was checked. The blackened ratio (imaged area) of the duplicated image was determined using 30% original.

The results obtained are shown in Table 12 below.

TABLE 12

| Test No. | Developer | Stains of Developing Apparatus | Image of the 2,000th Plate |
|---|---|---|---|
| 1 | Developer of Example | No toner residue adhered | Clear |
| 2 | Developer D | Toner residue greatly adhered | Letter parts lost, density of solid black part lowered, background fogged |
| 3 | Developer E | Toner residue adhered | Density of fine lines slightly lowered, Dmax lowered |
| 4 | Developer F | Toner residue adhered | Density of fine lines slightly lowered, Dmax lowered |

When each of the liquid developers was used for plate making under the aforesaid processing conditions, only the liquid developer to this invention caused no stains of the developing apparatus and gave clear images on the 2,000th plate.

Then, the offset printing master plate (ELP Master) prepared by processing using each of the liquid developers was used for printing in a conventional manner and the number of prints obtained before the occurrences of defects of letters on the images of the print, the lowering of the density of the solid black portions of the images, etc., was checked. The results showed that the master plate obtained by using each of the liquid developer of this invention and the liquid developers in Comparison Examples D and F gave more than 10,000 prints without accompanied by the aforesaid failures, while the master plate prepared using Comparison Liquid Developer E results in the failures after 8,000 prints.

As is clear from the aforesaid results, only the liquid developer of this invention could advantageously be used for preparing a large number of prints by the master plate obtained without causing stains of the developing apparatus.

In the case of using Comparison Liquid Developer D, there was no problem on the number of prints but the developing apparatus was too stained to further use continuously.

Also, in the cases of Comparison Liquid Developers E and F, the developing apparatus was stained (in particular, on the back surface of the electrode plate) when the developer was used under the condition of a rapid processing speed of 5 plates/minute (an ordinary processing speed was 2 or 3 plates/minutes) and after the formation of about 2,000 plates, the image quality of the duplicated images on the plate was reduced (the reduction of Dmax, lowering of the density of fine lines, etc.). There was no problem on the number of prints by the master plate in the case of using Comparison Liquid Developer F but the number thereof was reduced in the case of using Comparison Liquid Developer E.

These results show that the resin grains of this invention are clearly excellent.

EXAMPLE 28

A mixture of 100 g of the white dispersion obtained in Production Example 44 of latex grains and 1.5 g of Sumikalon Black was heated to 100° C. with stirring for 4 hours. After cooling to room temperature, the reaction mixture obtained was passed through a 200 mesh nylon cloth to remove the remaining dye, thereby a black resin dispersion having a mean grain size of 0.24 μm was obtained.

A liquid developer was prepared by diluting 32 g of the aforesaid black resin dispersion, 20 g of a higher alcohol, FOC-1600 (trade name, made by Nissan Chemical Industries, Ltd., hexadecyl alcohol), and 0.05 g of zirconium naphthenate, with one liter of Shellsol 71.

When the liquid developer was applied to the same developing apparatus as in Example 1 for development, no occurrence of stains of the developing apparatus by sticking of the toner was observed even after developing 2,000 plates.

Also, the image quality of the offset printing master plate obtained was clear and the image quality of the 10,000th print obtained using the master plate was very clear.

EXAMPLE 29

A mixture of 100 g of the white dispersion obtained in Production Example 74 of latex grains and 3 g of Victoria Blue was heated to a temperature of from 70° C. to 80° C. with stirring for 6 hours. After cooling to room temperature, the reaction mixture obtained was passed through a 200 mesh nylon cloth to remove the remaining dye, whereby a blue resin dispersion having a mean grain size of 0.25 μm was obtained.

A liquid developer was prepared by diluting 32 g of the aforesaid blue resin dispersion and 0.05 g of zirconium naphthenate with one liter of Isopar H.

When the liquid developer was applied to the same developing apparatus as in Example 1 for development, no occurrence of stains of the developing apparatus by sticking of the toner was observed even after developing 2,000 plates. Also, the image quality of the offset printing master plate obtained was clear and the image quality of the 10,000th print obtained using the master plate was very clear.

EXAMPLE 30

A liquid developer was prepared by diluting 32 g of the white resin dispersion obtained in Production Example 45 of latex grains, 2.5 g of the nigrosine dispersion obtained in Example 27, 15 g of a higher alcohol, FOC-1800 (trade name, made by Nissan Chemical Industries, Ltd, octadecyl alcohol), and 0.02 g of a semi-docosanylamidated product of a copolymer of diisobutyrene and maleic anhydride, with one liter of Isopar G.

When the liquid developer was applied to the same developing apparatus as in Example 1 for development, no occurrence of stains of the developing apparatus by sticking of the toner was observed. Also, the image quality of the offset printing plate obtained and the image quality of the 10,000th print obtained using the master plate were clear.

Furthermore, when the same processing was performed after allowing to stand the liquid developer for 3 months, the results were same as above.

EXAMPLE 31

In a paint shaker were placed 10 g of poly(decyl methacrylate), 30 g of Isopar H, and 8 g of Alkali Blue together with glass beads followed by dispersing for 2 hours to provide a fine dispersion of Alkali Blue.

Then, a liquid developer was prepared by diluting 30 g of the white resin dispersion D-65 obtained in Production Example 65 of latex grains, 4.2 g of the aforesaid Alkali Blue dispersion, and 0.06 g of a semi-docosanylamidated product of a copolymer of diisobutyrene and maleic anhydride, with one liter of Isopar G.

When the liquid developer was applied to the same developing apparatus as in Example 27 for development, the occurrence of stains of the developing apparatus by sticking of the toner was observed. Also, the image quality of the offset printing master plate obtained and the image quality of the 10,000th print obtained using the master plate were very clear.

EXAMPLES 32 TO 53

By following the same procedure as Example 31 except that each of the latexes shown in Table 13 below was used in place of the latex D-23 obtained in Production Example 23 of latex grains, each of liquid developers was prepared.

TABLE 13

| Example | Latex Grains | Example | Latex Grains |
|---|---|---|---|
| 32 | D-43 | 43 | D-57 |
| 33 | D-44 | 44 | D-58 |
| 34 | D-46 | 45 | D-59 |
| 35 | D-47 | 46 | D-60 |
| 36 | D-48 | 47 | D-63 |
| 37 | D-49 | 48 | D-64 |
| 38 | D-50 | 49 | D-66 |
| 39 | D-51 | 50 | D-67 |
| 40 | D-52 | 51 | D-71 |
| 41 | D-52 | 52 | D-72 |
| 42 | D-54 | 53 | D-73 |

When each of the liquid developers was applied to the same developing apparatus as in Example 27 for development, no occurrence of stains of the developing apparatus for development by sticking of the toner was observed even after developing 2,000 plates.

Also, the image quality of the offset printing master plates obtained was clear and the image quality of the 10,000th print obtained using each of the master plates was very clear.

Furthermore, when the aforesaid processing was repeated after allowing to stand each of the liquid developers for 3 months, the results were same as above.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising a resin dispersed in a non-aqueous solvent having an electric resistance of at least $10^9$ Ωcm and a dielectric constant of not higher than 3.5, wherein the dispersed resin is a polymer resin obtained by polymerizing a solution containing at least one monofunctional monomer (A) which is soluble in the aforesaid non-aqueous solvent but becomes insoluble after being polymerized, in the presence of at least one resin which is soluble in the aforesaid non-aqueous solvent and does not have a graft group polymerizable with the monomer and at least one oligomer (B) having a number average molecular weight of not more than $1\times10^4$ and having at least one polar group selected from a carboxy group, a sulfo group, a hydroxy group, a formyl group, an amino group, a phosphono group, and

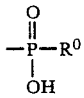

wherein $R^0$ represents a hydrocarbon group or $—OR^1$, (wherein $R^1$ represents a hydrocarbon group) bonded to one terminal only of the main chain of a polymer composed of a recurring unit represented by following formula (I):

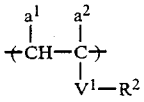

(I)

wherein $V^1$ represents —COO—, —OCO—, $-(CH_2)_7COO-$, $-(CH_2)_7OCO-$, —O—, $—SO_2—$, —CONHCOO—, —CONHCONH—,

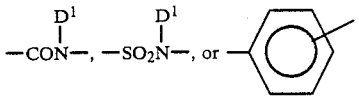

(wherein $D^1$ represents a hydrogen atom or a hydrocarbon group having from 1 to 22 carbon atoms and l represents an integer of from 1 to 3); $R^2$ represents a hydrocarbon group having from 1 to 22 carbon atoms, which may contain —O—, —CO—, $—CO_2—$, —OCO—, $—SO_2—$,

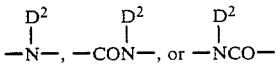

(wherein $D^2$ has the same meaning as $D^1$ described above) in the carbon chain thereof; and $a^1$ and $a^2$, which may be the same or different, each represents a hydrogen atom, a halogen atom, a cyano group, a hydrocarbon group having 1 to 22 carbon atoms, —COO—$D^3$, or —COO—$D^3$ bonded through a divalent hydrocarbon group having 1 to 22 carbon atoms (wherein $D^3$ represents a hydrogen atom or a hydrocarbon group having 1 to 22 carbon atoms which may be substituted).

2. The liquid developer for electrostatic photography as in claim 1, wherein the recurring unit shown in formula (I) of the oligomer (B) contains at least a recurring unit represented by following formula (Ia)

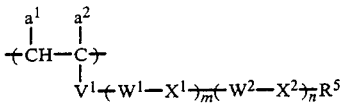

(Ia)

wherein $a^1$, $a^2$, and $V^1$ are same as those in formula (I); $R^5$ represents a hydrogen atom or a hydrocarbon group having from 1 to 22; $X^1$ and $X^2$, which may be the same or different, each represents —O—, —CO—, —$CO_2$—, —OCO—, —$SO_2$—,

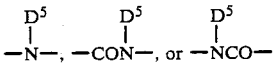

(wherein $D^5$ has the same meaning as $D^1$ in formula (I)); $W^1$ and $W^2$, which may be the same or different, each represents a hydrocarbon group having from 1 to 18 carbon atoms, which may be substituted or may have in the main chain bond

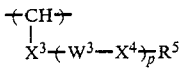

(wherein $X^3$ and $X^4$, which may be the same or different, have the same meanings as $X^1$ and $X^2$ described above and $W^3$ represents a hydrocarbon group having from 1 to 18 carbon atoms, which may be substituted); and m, n, and p each represents independently an integer of from 0 to 3, with the proviso that m, n and p cannot be 0 at the same time.

3. A liquid developer for electrostatic photography as in claim 1, wherein said monofunctional monomer is represented by the formula (A-1):

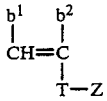

(A-1)

wherein T represents —COO—, —OCO, —$CH_2$OCO—, —$CH_2$COO—, —O—,

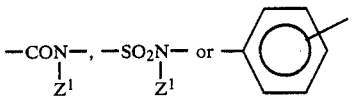

(wherein $Z^1$ represents a hydrogen atom or an aliphatic group having from 1 to 18 carbon atoms), Z represents a hydrogen atom or an aliphatic group having from 1 to 6 carbon atoms, and $b^1$ and $b^2$, which may be the same or different, each represents a hydrogen atom, a halogen atom, a cyano group, a hydrocarbon group having 1 to 22 carbon atoms, —COO—$D^3$, or —COO—$D^3$ bonded through a divalent hydrocarbon group having 1 to 22 carbon atoms (wherein $D^3$ represents a hydrogen atom or a hydrocarbon group having 1 to 22 carbon atoms which may be substituted).

4. A liquid developer for electrostatic photography as in claim 1, wherein the recurring unit represented by formula (I) is present in the oligomer (B) at a proportion of from about 30% to about 100% by weight.

5. A liquid developer for electrostatic photography as in claim 1, wherein said oligomer (B) is used in an amount of from about 0.05 to about 10% by weight based on the monomer (A).

6. A liquid developer for electrostatic photography as in claim 1, wherein the total amount of the monomer (A) and the oligomer (B) is from about 5 to about 80 parts by weight per 100 parts by weight of the non-aqueous solvent.

7. A liquid developer for electrostatic photography as in claim 1, wherein said resin which is soluble in said non-aqueous solvent is used in an amount of from about 1 to about 100 parts by weight per 100 parts by weight of the total amount of monomers.

* * * * *